US006722586B2

(12) United States Patent
Bonse et al.

(10) Patent No.: US 6,722,586 B2
(45) Date of Patent: Apr. 20, 2004

(54) PRESSURIZED INJECTOR WITH OPTIMIZED INJECTION BEHAVIOR THROUGHOUT THE CYLINDER PATH

(75) Inventors: Bernhard Bonse, Stuttgart (DE); Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/991,832

(22) Filed: Nov. 6, 2001

(65) Prior Publication Data

US 2002/0079386 A1 Jun. 27, 2002

(30) Foreign Application Priority Data

Nov. 10, 2000 (DE) ..... 100 55 651

(51) Int. Cl.[7] ..... F02M 41/00

(52) U.S. Cl. ..... 239/533.3; 239/96; 239/99; 239/124; 239/489

(58) Field of Search ..... 239/88–92, 99, 239/124–127, 533.2–533.11, 489

(56) References Cited

U.S. PATENT DOCUMENTS

| | | | | | |
|---|---|---|---|---|---|
| 2,647,015 | A | * | 7/1953 | Berlyn | 239/99 |
| 2,647,016 | A | * | 7/1953 | Berlyn | 239/99 |
| 3,387,790 | A | * | 6/1968 | De Luca | 239/533.3 |
| 4,528,951 | A | * | 7/1985 | Yamada | 239/533.3 |
| 4,650,121 | A | * | 3/1987 | Augustin | 239/533.11 |
| 5,551,634 | A | * | 9/1996 | Raab et al. | 239/96 |

* cited by examiner

*Primary Examiner*—Dinh Q. Nguyen
(74) *Attorney, Agent, or Firm*—Michael J. Striker

(57) ABSTRACT

The invention concerns an injector for the injection of fuel into the combustion chambers of combustion engines. Inside an injector housing (9) is located a nozzle needle (14), which is surrounded by a nozzle chamber (18). The nozzle needle (14) is moveable back and forth within the injector housing, and is aligned by the guiding sections (16, 22) inside the injector housing (9). A thick spring (11) pressed the nozzle needle against the injector (14) a ring canal (23) is formed between injector housing (9) and nozzle needle (14) and a conical section (33) of said nozzle needle (14) follows in the direction towards the seat (30).

8 Claims, 3 Drawing Sheets

PRESSURIZED INJECTOR WITH OPTIMIZED INJECTION BEHAVIOR THROUGHOUT THE CYLINDER PATH

BACKGROUND OF THE INVENTION

This invention concerns fuel injection systems for direct injection combustion engines, in general, and in particular, those fuel injection systems which contain valve bodies that are moveable back and forth across an operational unit in a vertical direction in the injector housing. The start of injection and the amount of fuel injected are adjusted for the injectors which are admitted into the top of the cylinder area, projecting into the individual combustion spaces of the combustion engine, and are maintained during the operation of the combustion engine. The injectors are, as a rule, fitted into the cylinder top area of the combustion engine without major structural alteration.

DE 197 01 879 A1 discloses a fuel injection system for fuel engines. The arrangement known from this reference involves a high pressure pump, which fills a fuel-fillable common high pressure container (Common Rail) with fuel. The same high pressure container is connected with an injection valve which projects into the combustion area of the engine to be fueled, the opening and closing movements of which valves are controlled by an electrically operated control valve, whereby the control valve is formed as a 3/2-way valve, which is connected to a high pressure canal flowing into an injector opening of the injector valve, by means of the injector conduit or a drainage conduit. Thereby, is provided at the control valve joint of the control valve a workspace hydraulically fillable with high pressure fuel, which is controllable for adjustment of the positioning of the control valve joint of the control valve into a drainage canal.

DE 198 35 494 A1 discloses a pump nozzle unit. This serves for the supply of fuel into a combustion space of direct injection combustion engines with a pump unit for the buildup of injection pressure and for the injection of the fuel across an injection nozzle into the combustion space. The teachings of this reference embrace, moreover, a control unit with a control valve which is formed as an outer opening A-valve, as well as a valve operational unit for control of the pressure buildup inside the pump unit. In order to provide a pump-nozzle unit with a control unit, which has a simple construction, is small in size and in particular has a short response time, it is suggested according to the present invention to form the valve operational unit as a piezoelectrically active unit.

SUMMARY OF THE INVENTION

With the configuration suggested according to the present invention of a nozzle needle of an injector for the injection of fuel into the combustion space of combustion engines, a slanted configuration can be formed for the course of the fuel injection throughout the cylinder path, and thereby the behavior of the fuel injection. The slant is formed between a control surface provided on the inside of the housing, which attaches to a control edge of the injector housing, and a conical area provided on the nozzle needle. On the side of the nozzle needle, the conical section is situated opposite the portion of the area of the borehole in the injector housing, in which the needle nozzle is moveable back and forth.

Above a constriction in the nozzle needle there is located an upper management section of the nozzle needle. Free surfaces are provided inside this upper management section, across which the fuel can flow from the nozzle space into which it enters under high pressure from the high pressure collecting area, in the direction of the point of the nozzle needle. In more advantageous manner, the management section of the nozzle needle provided by means of the mentioned free surfaces, defines a ring shaped canal. The ring shaped canal functions between a straight surrounding section of the nozzle needle and a front surface section of the wall of the housing, as a throttle element next to the lower end of the nozzle needle, which thanks to its conical formation likewise functions as a throttle element. Across the ring shaped canal which functions as a throttle element, there enters during a first partial stroke of the nozzle needle within the injector housing only a small volume of fuel into the combustion space of the combustion engine. In this manner, a continuous ignition delay can be set at the start of the injection operation up until complete development of the flame front in the combustion space. Through further elevation of pressure at the pressure stage of the nozzle needle in the nozzle space, the nozzle needle will be upwardly driven towards the effect of the thick spring, so as to produce during the further cylinder path of the nozzle needle, a gradual widening of the distance between the control surface provided in the wall of the housing and the conical area of the nozzle needle. The result is that from the start of the spraying, the effective ring shape canal is continuously widened during the further cylinder path of the nozzle needle and a greater volume of fuel can be transported. The increase in the amount of injected fuel obtainable by means of the conical surface of the nozzle needle is implemented first after a complete formation of the flame front in the combustion space, so that the ignition delay disappears and an increased volume of fuel will be sprayed at the right time into the combustion space of the combustion engine, namely when the thermodynamic conditions are optimal therefor.

An accurate prescription for the course of the pressure buildup during the injection phase depends upon the length of the slope of the conical area of the nozzle needle, furthermore on the angle of the pitched surface relative to the front surface, and upon the vertical cylinder path of the nozzle needle within the injector housing.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
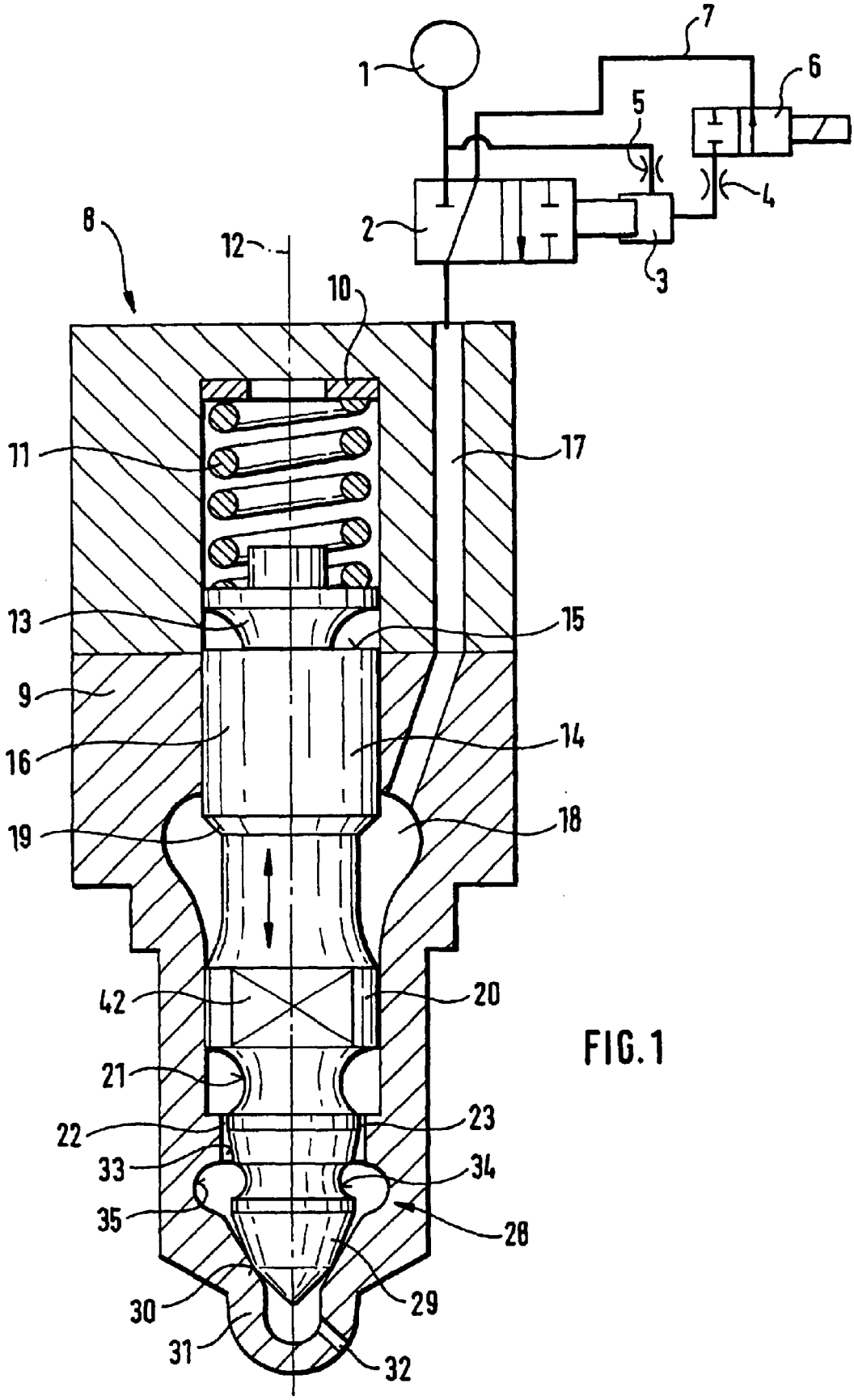
FIG. 1 is a longitudinal section through a nozzle needle with a tooled slant, placed inside an injector housing in accordance with the present invention.

FIG. 1 of the drawings more closely illustrates a longitudinal section through a nozzle needle which is surrounded by an injector housing.

FIG. 1 shows an injector 8 for the injection of fuel into the combustion space of a combustion engine, which is connected to a high pressure collecting area 1 (Common Rail). The conduit stretching from high pressure collecting area 1 (Common Rail), which flows into nozzle chamber input 17, passes through a 3/2-way valve 2. This valve is controlled, as shown in this particular embodiment, by means of control chamber 3, which receives fuel through a branch from the pressure conduit from high pressure collecting area 1 and an inflow choke 5 therefrom, which provides a control volume. A change in the pressure inside control chamber 3 can be carried out by means of a 2/2-way control valve 6, which connects as seen with drainage conduit 7. Additionally, an outflow choke 4 is associated with the pressure relief conduit of control chamber 3.

Injector 8 substantially encloses the introduced nozzle needle 14, which is admitted into a borehole in the injector housing 9. The nozzle needle 14 is associated at its top surface 15 with a cone-shaped pressure piece 13, The cone-shaped pressure piece 13 abuts on one side the thick spring 11, provided as a spiral spring, which shores up the support element 10 provided at the top interior of injector housing 9. Support element 10, cone-shaped pressure piece 13, as well as nozzle needle 14 are all constructed rotationally symmetric to the axis of symmetry 12. Beneath the top area of needle nozzle 14, which is formed as a first guide section 16, there is located in injector housing 9 a nozzle chamber 18, which is supplied with high pressure fuel from high pressure collecting area 1, through 3/2-way control valve 2 and nozzle chamber input conduit 17. Inside nozzle chamber 18 within injector housing 9, the nozzle needle 14 is shaped with a pressure stage 19. Pressure stage 19 brings about, upon supply of pressure into nozzle chamber 18 the driving nozzle needle 14 and therewith the release of injection hole 32. The vertical cylinder pathway of nozzle needle 14 is schematically illustrated in the representation according to FIG. 1, by means of the double arrow next to axis of symmetry 12. Beneath a constricted section of nozzle needle 14, which is substantially enclosed by nozzle chamber 18 within injector housing 9, below the nozzle chamber 18. In order to make possible the flow of fuel entering nozzle chamber 18 to the conically formed nozzle needle point, there is disposed within the second guiding section 20, below nozzle chamber 18 a free surface 42. It is across free surface 42 that the high pressure fuel enters into the area of the borehole inside of injector housing 9, which is limited on the nozzle needle side by constricted area 21.

Beneath constricted area 21 there is located a ring-shaped extension of nozzle needle 14, and a conical area 33, which is embodied in the nozzle needle head. Below conical area 33 there follows a ring-shape chamber 28, which is bounded on the housing side by a ring groove 35, and on the nozzle needle side by a further constricted area 34 of the nozzle needle 14. Below this ring chamber 28 the nozzle needle is shaped at its point side into a conical seat 29, on which is formed seat diameter 30. By means of seat diameter 30, the point of nozzle needle 14 is driven against a seat formed by the wall 31 of injector housing 9, and it is locked in place there by means of the effect of thick spring 11 and also the force of pressure adjusting through injection opening 32 to the upper end 15 of nozzle needle 14. At injection opening 32, the injector 8 configured in accordance with the present invention, illustrated by FIG. 1, projects into the combustion space of a combustion engine.

Figure 2:
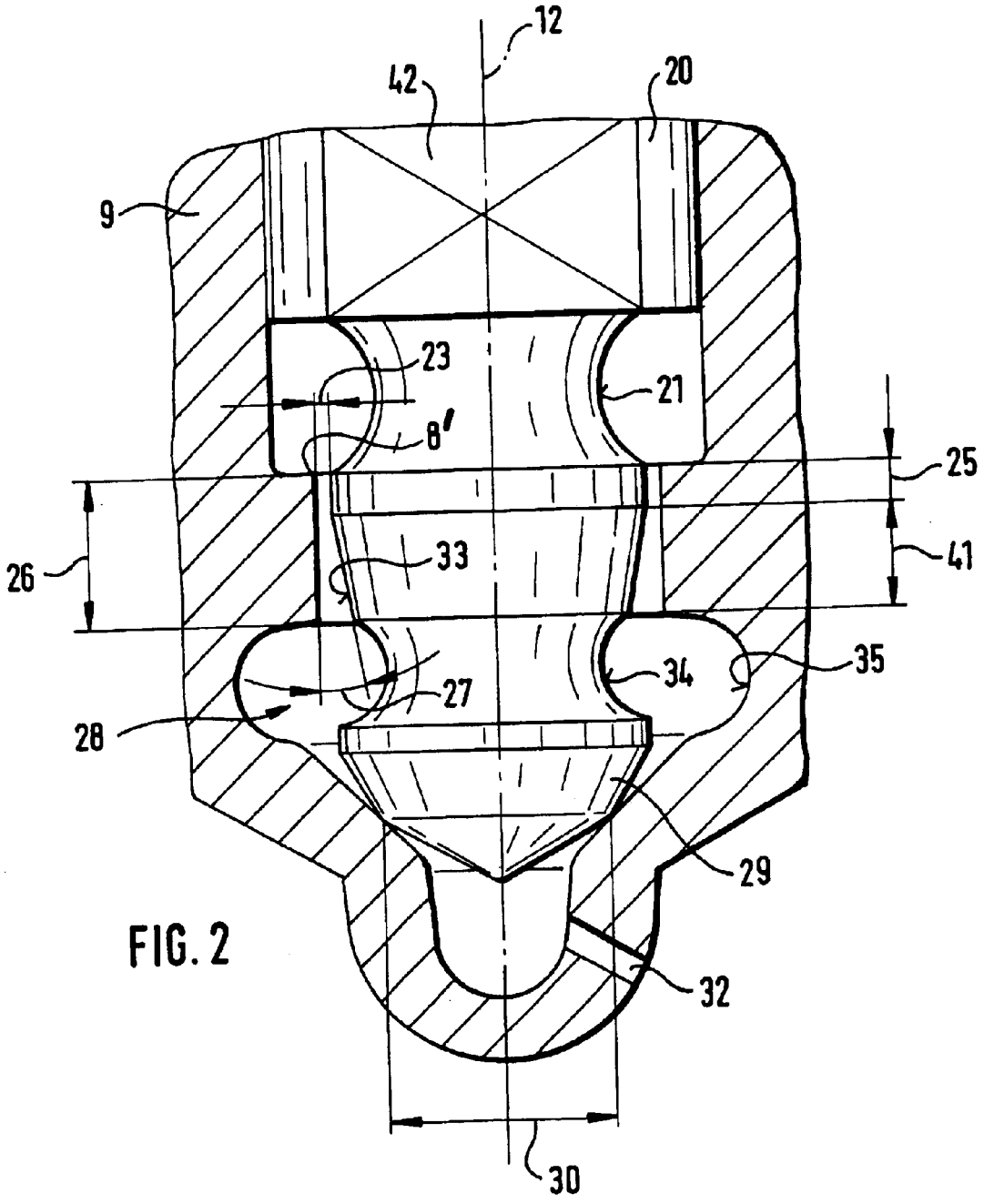
FIG. 2 is a magnified section from FIG. 1, showing the tooled slant formed on the nozzle needle, opposite a control surface inside of the housing.

The illustration according to FIG. 2 shows the construction of the control surfaces inside of the housing, opposite the tooled slant of the nozzle needle.

In accordance with the representation of FIG. 2 one sees an enlarged section, including, beneath the second guiding section 20 and the constricted area 21 which follows on nozzle needle 14, a control surface stretching from control edge 8' provided inside of the housing, which forms a throttle place having variable cross-section opposite that section of the nozzle needle. The throttle cross-section varies, depending upon the path of the nozzle needle 14 inside of injector housing 9. The control surface which follows control edge 8' on the inside of the housing runs vertically downwardly and is formed by the wall of injector housing 9. This wall is opposite a ring-shaped section of the nozzle needle, thereby defining a canal height 25 (h1). The canal, formed between the ring-shaped area of nozzle needle 14 and the section of the control surface of injector housing 9 lying opposite, is designated by reference numeral 23. The cross-sectional surface of canal 23 is designated by reference numeral 22, which refers to the free canal surface and which forms a throttle place. Adjacent to the ring-shaped section of nozzle needle 14 which stretches across canal height 25 (h1) there is associated a conical area 33 The conical area 33 opens in the direction of the point of nozzle needle 14. Between the vertical of the downwardly stretching control surface adjacent to the control edge 8' of injector housing 9 and the surface of the conical section of the needle nozzle 14 is defined an angle δ identified as 27. After the conical section 33 of nozzle needle 14, the axial extent of which is designated by reference numeral 41 (h3), a ring groove 34 is provided on the nozzle needle 14. The ring groove 34 forms, according to the representation of FIG. 2, along with ring groove-shaped section 35 of the interior wall of injector housing 9, a ring chamber. Following chamber 28 one sees a throttle place with variable cross-section, through which flows the fuel as it passes conical seat 29 of nozzle needle 14 along the direction towards the nozzle point; and injector opening 32.

The length of the control surface associated beneath control edge 8 on the inside wall of injector housing 9 is designated by reference numeral 26, and corresponds approximately to the canal height 25 (h1) and the extent of conical section 33, parallel to the axis of symmetry 12 of nozzle needle 14.

Figure 3:
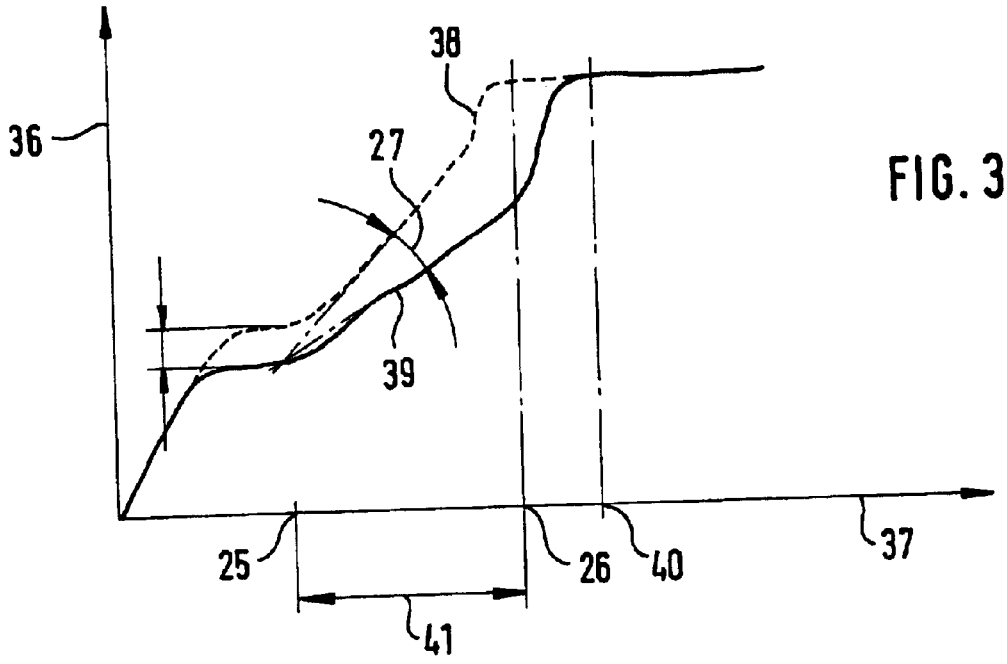
FIG. 3 is a graph showing the timing for the course of the injection pressure for the needle nozzle in accordance with the present invention, taken relative to the cylinder path.

FIG. 3 illustrates the adjusting of the course of the injection pressure with the nozzle needle configured in accordance with th present invention, always taken across the piston path of the nozzle needle.

Reference numeral 36 designates the course of the injection pressure, as a function of the cylinder path 37 of the nozzle needle 14. In the diagram according to FIG. 3, one sees represented the pressure course characteristics 38 and 39. Indeed, depending upon the selected axial length of control surface 22 beneath control edge 8, canal height 25 and the axial extent of conical section 33 in the direction of the axis of symmetry 12 of nozzle needle 14, and depending upon selected angle 27 of the conical section 33 relative to the vertically running borehole inside injector housing 9, one obtains a flatter injection pressure curve 39 or a steeper injection pressure curve 38. One sees from the represented course of pressure characteristics 38 and 39, that initially an asymptotically running pressure curve is produced, so long as control edge 8 and the area of canal height 25 cover each other, that is, until the start of the vertical driving phase of nozzle needle 14 against the effect of thick spring 11. During this phase, that is a first partial path of nozzle needle 14 inside injector housing 9, the throttle cross-section remains constant until it first begins to increase as control edge 8 overlays the start of the conical section of the nozzle needle.

During this further partial path, across piston length 41, that is the axial extent of nozzle needle 14 corresponding to the conical section, the throttle cross-section is continuously widened upon further vertical movement of the nozzle needle against the effect of thick spring 11. Depending upon the angle of incline 27, the cross-section increases, whereby a faster obtaining of a high pressure level according to the dashed line (course of injection pressure 38 in FIG. 3) can be accomplished. In this area of the graph, designated by reference numeral 41, in which the throttle cross-section increases continuously, one sees a steeper pressure slope section, so that the maximum pressure is reached more quickly. Indeed, according to the selected axial extent 41 (h3) of conical section 33, as well as the selected slant angle 27, the increase in pressure according to FIG. 3 can advantageously be adjusted to follow either pressure course characteristics 38 or 39. Axial extent 26 (h2) of the control surface provided on the inside of the housing corresponds at least to both partial path 25 and partial path 41, during execution of the driving of nozzle needle 14 against the effect of thick spring 11.

Figure 4:
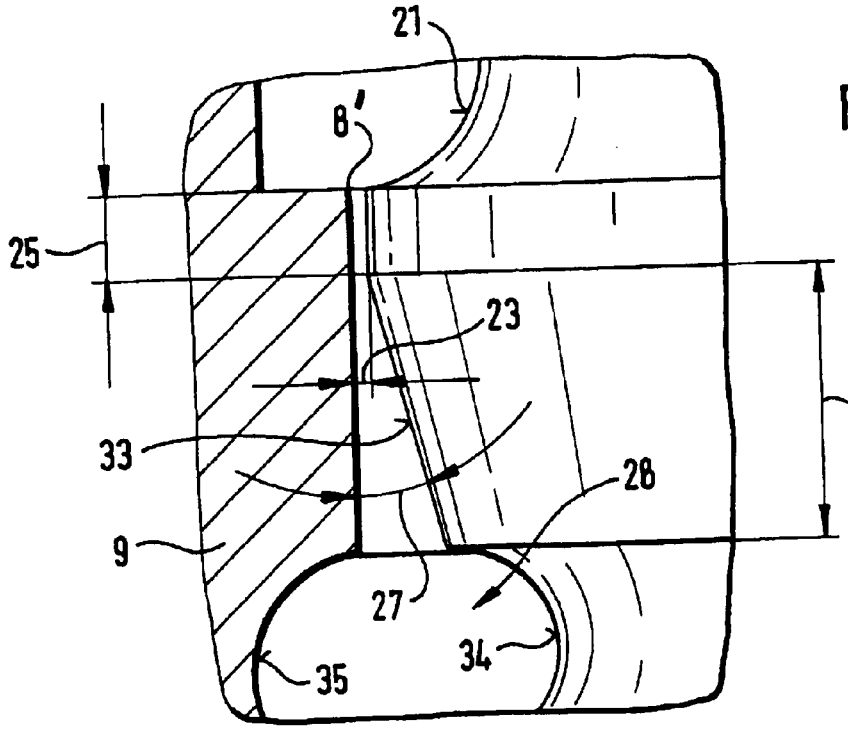
FIG. 4 is a magnified representation of the control edge and control surface of the inside of the housing, which lie opposite a pitched surface formed on the nozzle needle which is driven through the course of the injection pressure.

The representation according to FIG. 4 is an enlarged display of the control edge on the inside of the housing, which is located across the inclined surface formed on the nozzle needle, throughout the buildup of the injector pressure. The total pathway 40 of nozzle needle 14 is in advantageous manner so selected that it is always either equal to partial path 25 (h1) plus partial path 41 (h3) or, both partial path 25 and partial path 41 are so selected that their sum is smaller than the total pathway 40 of nozzle needle 14. With the nozzle needle 14 inserted into injector housing 9, configured in accordance with the present invention, one can produce not only an increase in the course of pressure, but through adjustment of the ring canal diameter 23 as well as the partial pathways 25 and 41 on the side of the nozzle needle, and also the length of the control surface associated with control edge 8' on the side of the housing, the pressure characteristics of the pressure buildup can be adjusted. The opening pressure of nozzle needle 14 can be influenced by the configuration of pressure stage 19, which is formed on the nozzle needle section in the area of thee enclosed nozzle chamber 18. The opening pressure of the nozzle needle 14 is determined by the dimensioning of thick spring 11, which is provided within injector housing 9 above the top surface 15 of nozzle needle 14. In connection therewith, it makes no difference whether the injector is directly controlled across a 3/2 way valve 2 or is controlled by means of an operational unit, for example a piezoactive or a magnetic valve.

With the solution suggested according to the present invention, one can obtain a control of the injection pressure not only during a partial path range of the injector but also throughout its entire cylinder pathway running in a vertical direction. In so doing, depending upon configuration of the conical area 33 as well as the axial dimension of control surface 22 within injector housing 9, one can arrive at the most discriminating degree of customer adjustment of the injection characteristics, be it for direct-injection combustion engines in personal motor vehicles or in commercial vehicles, taking into account a full range of fine tuning.

It will be understood that each of the elements described above, or two or more together, may also find a useful application in other types of constructions differing from the types described above.

While the invention has been illustrated and described as embodied in a pressure controlled injector with optimized injection characteristics throughout the cylinder path, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from that the standpoint of prior art, fairly constitute essential characteristics of the generic or specific aspects of this invention.

What is claimed as new and desired to be protected by Letters Patent is set forth in the appended claims.

We claim:

1. Injector for injecting fuel into combustion chambers of combustion engines, having an injector housing, in which a nozzle needle, enclosed by a nozzle chamber is movable back and forth vertically, the nozzle needle being movable back and forth vertically along guiding sections within the injector housing and pressed at its seat against the injector housing by means of a thick spring, comprising said nozzle needle includes a constricted section defining a ring canal between said injector housing and said nozzle needle, and said nozzle needle further containing a conical section in direction of a seat of said nozzle needle, said conical section below said ring canal displaying a throttle surface, and said injector housing displaying on an inside thereof, a control surface lying opposite said throttle surface, said throttle surface inclined relative to said control surface at an angle δ.

2. The injector according to claim 1, wherein said ring canal possesses an axial length along said nozzle needle, said axial length constituting a first partial cylinder pathway for said nozzle needle.

3. The injector according to claim 1, wherein said conical section of said nozzle needle possesses an axial length which corresponds to a further cylinder path of the nozzle needle within the injector housing.

4. The injector according to claim 1, wherein said control surface of said injector housing displays an axial length corresponding to a total cylinder pathway of the nozzle needle within the injector housing.

5. The injector according to claim 4, wherein the sum of said axial length of said ring canal and said axial length of said conical section being less than the total cylinder pathway of said nozzle needle.

6. The injector according to claim 1, said control section of said nozzle needle and said control surface of said injector housing together constituting a throttling area.

7. Injectors for injecting fuel into combustion chambers of combustion engines, each of said injectors having an injector housing, in which a nozzle needle, enclosed by a nozzle chamber is movable back and forth vertically, the nozzle needle being movable back and forth vertically along guiding sections within the injector housing and pressed at its seat against the injector housing by means of a thick spring, comprising said nozzle needle includes a constricted section defining a ring canal between said injector housing and said nozzle needle, and said nozzle needle further containing a conical section in direction of a seat of said nozzle needle, wherein below said conical section, said nozzle needle possesses a ring groove, and an inside of said housing possesses a corresponding ring groove, and wherein said ring groove on said housing side and said ring groove on said nozzle needle side together define a ring chamber, and said nozzle needle further comprising at its bottom a conical seat section, said conical seat section adjoining said ring chamber.

8. Injectors for injecting of fuel into combustion chambers of combustion engines, each of said injectors having an injector housing, in which a nozzle needle, enclosed by a nozzle chamber is movable back and forth vertically, the nozzle needle being movable back and forth vertically along guiding sections within the injector housing and pressed at its seat against the injector housing by means of a thick spring, comprising said nozzle needle includes a constricted section defining a ring canal between said injector housing and said nozzle needle, and said nozzle needle further containing a conical section in direction of a seat of said nozzle needle, wherein said nozzle needle further comprising below said nozzle chamber a free surface of one of said guiding sections, along which free surface fuel is able to flow longitudinally to said ring canal between said nozzle needle and said injector housing.

* * * * *